US007793362B1

(12) United States Patent
Stoby et al.

(10) Patent No.: US 7,793,362 B1
(45) Date of Patent: Sep. 14, 2010

(54) TOILET SEAT LIFT SYSTEM

(76) Inventors: Owen Stoby, 1719 McDaniel Ave., Evanston, IL (US) 60201; Audrey Stoby, 1719 McDaniel Ave., Evanston, IL (US) 60201

( * ) Notice: Subject to any disclaimer, the term of this patent is extended or adjusted under 35 U.S.C. 154(b) by 587 days.

(21) Appl. No.: 11/757,532

(22) Filed: Jun. 4, 2007

(51) Int. Cl.
*A47K 13/10* (2006.01)

(52) U.S. Cl. ..... 4/228.1; 4/222; 4/246.3

(58) Field of Classification Search ..... 4/246.1–246.5, 4/234–236, 240, 222
See application file for complete search history.

(56) References Cited

U.S. PATENT DOCUMENTS 1,491,780 A * 4/1924 Abbott ..... 292/347
2,251,770 A * 8/1941 Warner ..... 4/246.3
2,716,243 A * 8/1955 Kimzey ..... 4/222
2,795,799 A * 6/1957 Dickerman ..... 4/222
5,031,252 A * 7/1991 Oyama ..... 4/233
5,842,235 A * 12/1998 Miyazaki ..... 4/236

* cited by examiner

*Primary Examiner*—Gregory L Huson
*Assistant Examiner*—Janie Christiansen

(57) ABSTRACT

A toilet seat lift system for a toilet having a toilet bowl is disclosed. An illustrative embodiment of the toilet seat lift system includes a seat connecting shaft adapted for attachment to the toilet bowl, a toilet seat carried by the seat connecting shaft, a cover connecting rod extending through the seat connecting shaft, a toilet cover carried by the cover connecting rod, a seat handle carried by the seat connecting shaft and a cover handle carried by the cover connecting rod.

10 Claims, 4 Drawing Sheets

TOILET SEAT LIFT SYSTEM

FIELD

The present invention relates to apparatus for lifting a toilet seat on a toilet. More particularly, the present invention relates to a toilet seat lift system which facilitates selective raising and lowering of a toilet seat and/or cover on a toilet.

BACKGROUND

A conventional toilet includes a toilet bowl to which is pivotally attached a toilet seat and a toilet lid. Prior to use, the toilet lid or both the toilet lid and toilet seat must be raised. Lifting of the toilet lid and toilet seat is typically performed manually and is unhygienic in some cases.

SUMMARY

The present invention is generally directed to a toilet seat lift system. An illustrative embodiment of the toilet seat lift system includes a seat connecting shaft adapted for attachment to the toilet bowl, a toilet seat carried by the seat connecting shaft, a cover connecting rod extending through the seat connecting shaft, a toilet cover carried by the cover connecting rod, a seat handle carried by the seat connecting shaft and a cover handle carried by the cover connecting rod.

BRIEF DESCRIPTION OF THE DRAWINGS

The invention will now be described, by way of example, with reference to the accompanying drawings, in which.

DETAILED DESCRIPTION

Figure 1:
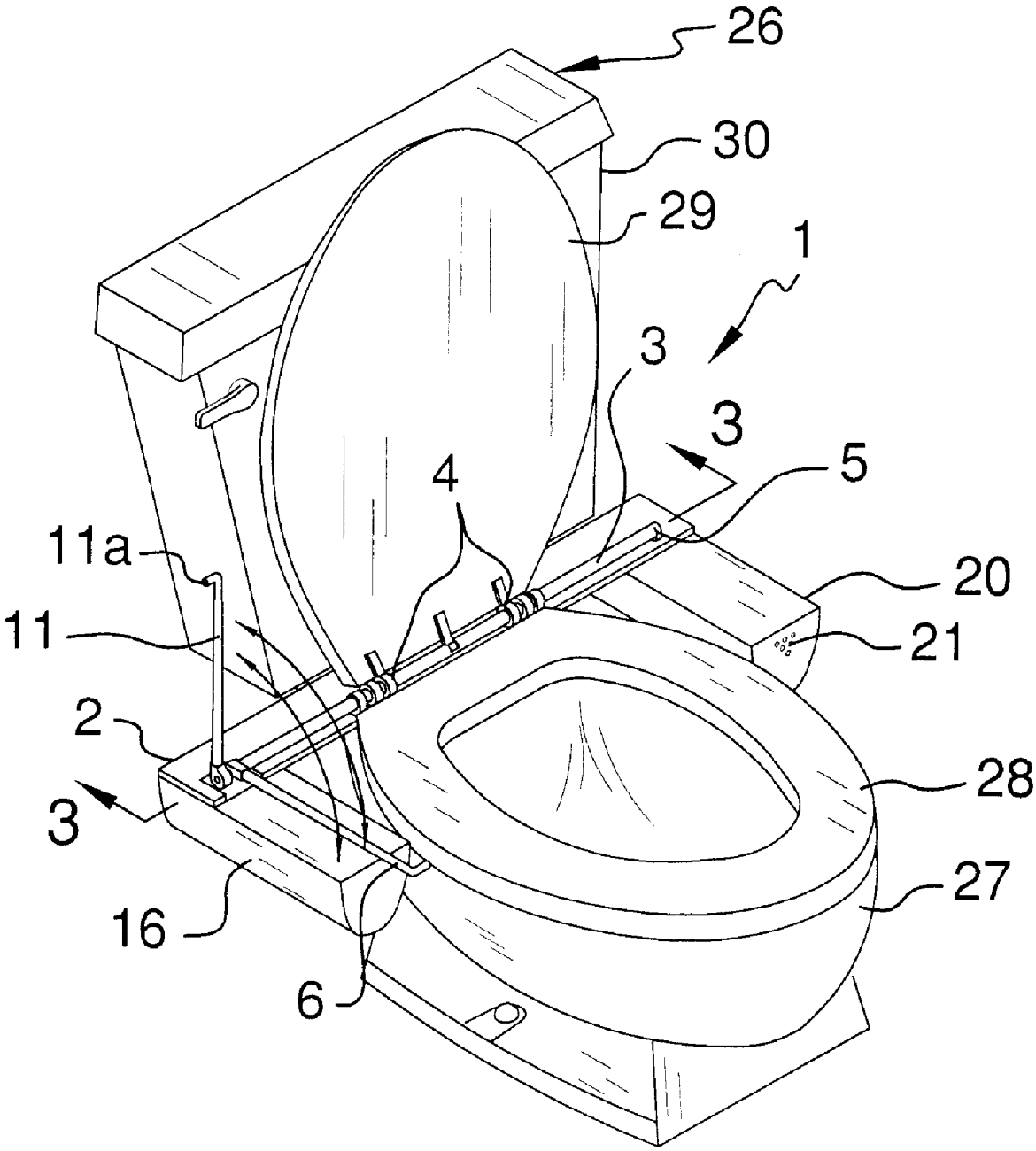
FIG. 1 is a perspective view of a toilet, with an illustrative embodiment of the toilet seat lift system provided on the toilet.

Referring to the drawings, an illustrative embodiment of the toilet seat lift system, hereinafter system, is generally indicated by reference numeral 1. The system 1 is adapted for attachment to a toilet 26 which includes a toilet bowl 27. A toilet seat 28 and a toilet cover 29 are pivotally mounted on the toilet bowl 27 in a manner which will be hereinafter described. A water tank 30 is provided on the toilet bowl 27 to provide water to the toilet bowl 27 typically in the conventional manner.

Figure 6:
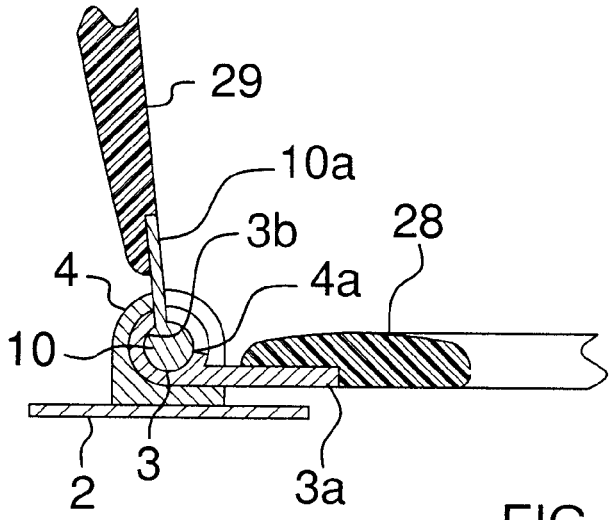
FIG. 6 is a sectional view, taken along section lines 6-6 in FIG. 2, of a shaft mount bracket element of an illustrative embodiment of the toilet seat lift system.

The system 1 includes a mounting plate 2 which typically has a generally elongated, rectangular shape. The mounting plate 2 is attached to the toilet bowl 27 between the toilet seat 28 and the water tank 30 using fasteners (not shown) and/or other attachment technique which is known to those skilled in the art. An elongated, rotatable seat connecting shaft 3 is mounted on the mounting plate 2 according to the knowledge of those skilled in the art. In some embodiments, a pair of spaced-apart shaft mount brackets 4 is provided on the toilet bowl 27. As shown in FIG. 6, the seat connecting shaft extends through a shaft opening 4*a* provided in each shaft mount bracket 4. A shaft flange 3*a* extends from the seat connecting shaft 3. The toilet seat 28 of the toilet 26 is attached to the shaft flange 3*a* using fasteners (not shown) and/or other attachment technique which is known to those skilled in the art.

Figure 5:
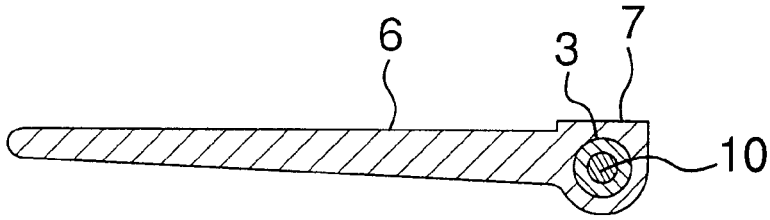
FIG. 5 is a sectional view, taken along section lines 5-5 in FIG. 2, of a seat handle element of an illustrative embodiment of the toilet seat lift system.

As shown in FIG. 5, an elongated seat handle 6 includes a seat handle base 7 through which the seat connecting shaft 3 extends. The seat handle base 7 is non-rotatable with respect to the seat connecting shaft 3. Accordingly, the toilet seat 28 can be selectively raised and lowered by raising and lowering, respectively, of the seat connecting shaft 3 as the seat connecting shaft 3 rotates with respect to the shaft mount brackets 4.

Figure 3:
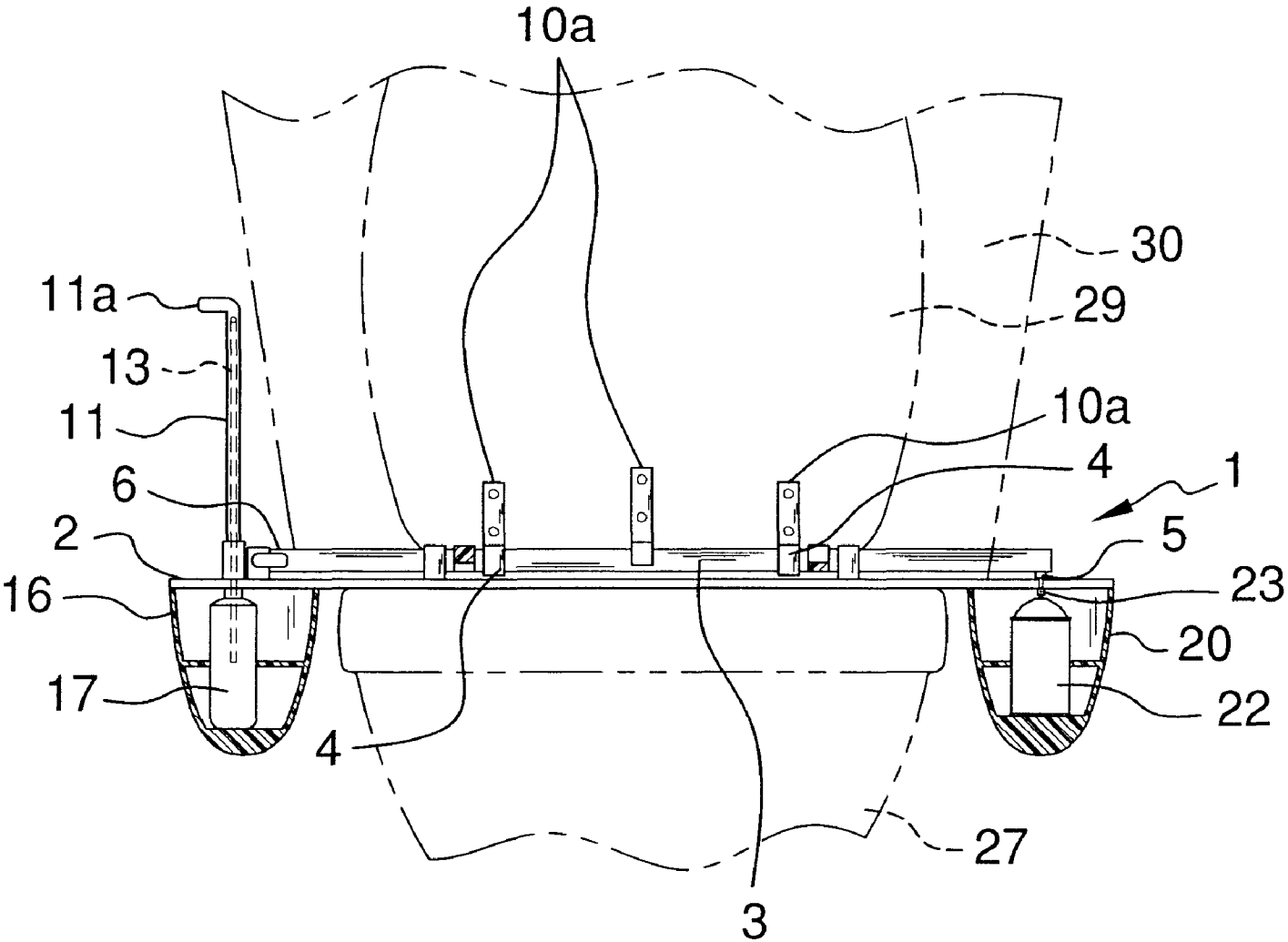
FIG. 3 is a sectional view, taken along section lines 3-3 in FIG. 1, of a sanitizer compartment and an air freshener compartment of an illustrative embodiment of the toilet seat lift system.

In some embodiments of the system 1, an air freshener compartment 20, typically having multiple air freshener openings 21, is provided on the mounting plate 2. As shown in FIG. 3, an air freshener bottle 22 which contains a supply (not shown) of pressurized air freshener is provided in the air freshener compartment 22. The air freshener bottle 22 typically has a spray nozzle 23 which can be depressed to spray the air freshener (not shown) from the air freshener bottle 22, typically in the conventional manner. A spray activation linkage 5 is provided between the seat connecting shaft 3 and the spray nozzle 23 to facilitate depression of the spray nozzle upon rotation of the seat connecting shaft 3 as the seat handle 6 is pivoted from the upper position to the lowered position.

As further shown in FIG. 6, a cover connecting rod extends through a rod opening 3*b* provided in the seat connecting shaft 3. A rod flange 10*a* extends from the cover connecting rod 10. The toilet cover 29 is attached to the rod flange 10*a* using fasteners (not shown) and/or other attachment technique which is known to those skilled in the art.

Figure 4:
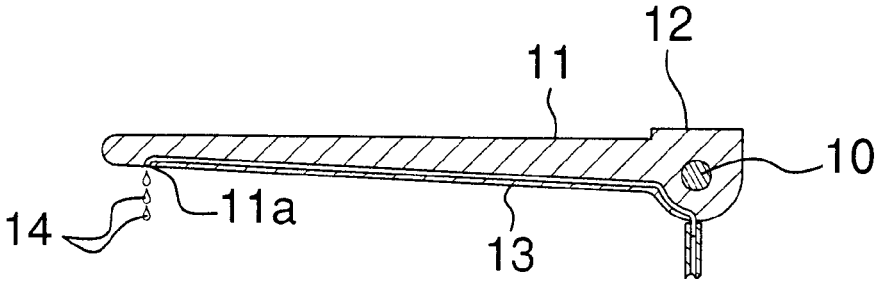
FIG. 4 is a sectional view, taken along section lines 4-4 in FIG. 2, of a cover handle element of an illustrative embodiment of the toilet seat lift system.

As shown in FIG. 4, a cover handle 11 includes a cover handle base 12 through which the cover connecting rod 10 extends. The cover handle base 12 is non-rotatable with respect to the cover connecting rod 10. Accordingly, the toilet cover 29 can be selectively raised and lowered by raising and lowering, respectively, of the cover handle 11 as the cover connecting rod 10 rotates with respect to the seat connecting shaft 3.

In some embodiments of the system 1, a sanitizer compartment 16 is provided on the mounting plate 2. As shown in FIG. 3, a sanitizer bottle 17 which contains a supply of liquid sanitizer 14 (FIG. 4) is provided in the sanitizer compartment 16. As shown in FIGS. 3 and 4, a sanitizer fluid conduit 13 extends through the cover handle 11 and is disposed in fluid communication with the sanitizer bottle 17. A dispensing nozzle 11*a* is provided in the cover handle 11 and communicates with the sanitizer fluid conduit 13. Accordingly, upon lowering of the cover handle 11, the liquid sanitizer 14 is dispensed from the sanitizer bottle 17, through the sanitizer fluid conduit 13 and from the dispensing nozzle 11*a*.

Figure 2:
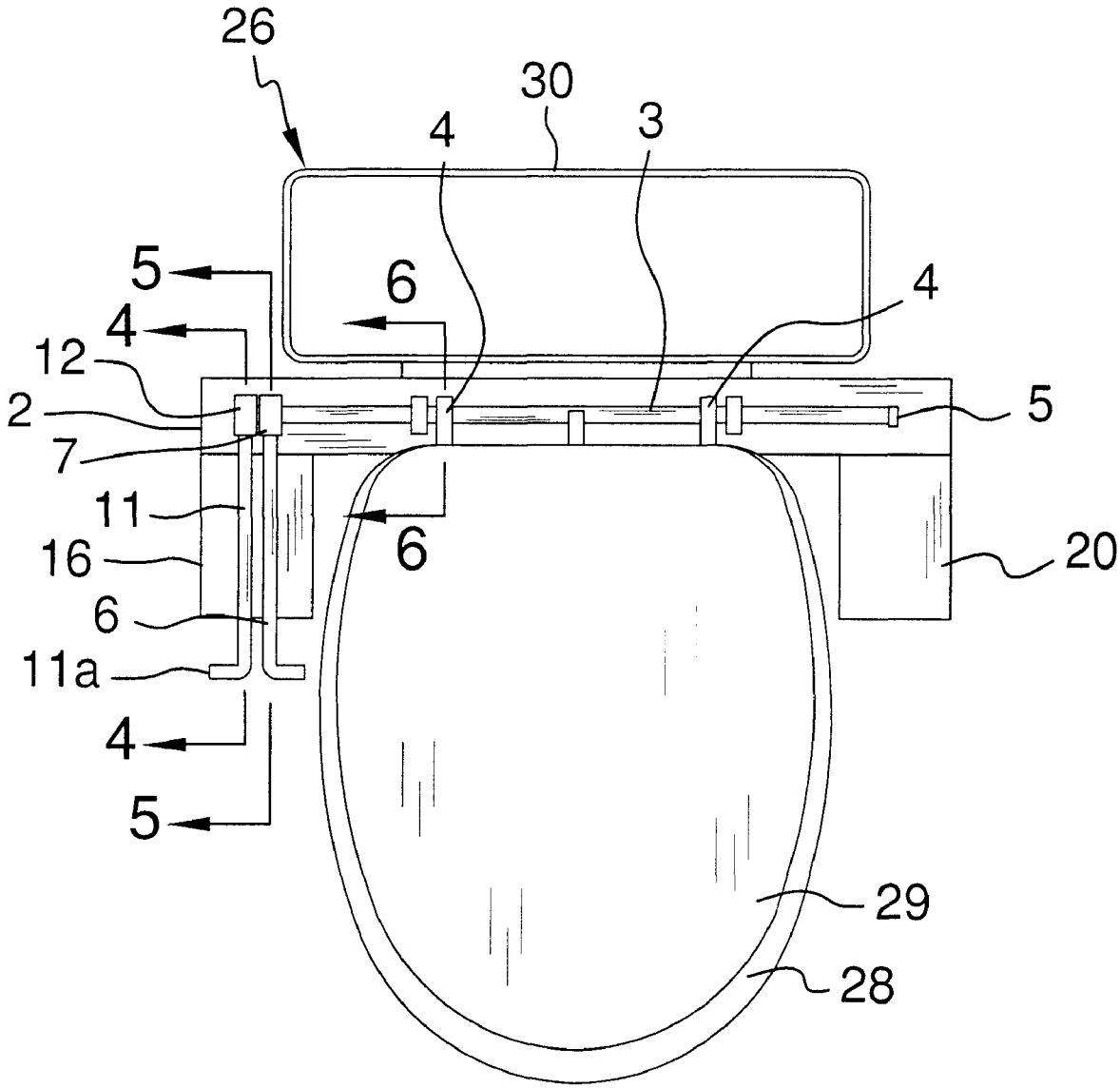
FIG. 2 is a top view of a toilet, with an illustrative embodiment of the toilet seat lift system provided on the toilet.

In typical application of the system 1, the seat handle 6 and the cover handle 11 are disposed in the lowered position shown in FIG. 2 when the toilet seat 28 is closed on the toilet bowl 27 and the toilet cover 29 is closed on the toilet seat 28. The cover handle 11 can be selectively raised as shown in FIG. 1 to raise the toilet cover 29 from the toilet seat 28 through rotation of the cover connecting rod 10. The seat handle 6 can be selectively raised to raise the toilet seat 28 from the toilet bowl 27 through rotation of the seat connecting shaft 3. Upon subsequent lowering of the toilet seat 28 back onto the toilet bowl 27 by lowering of the seat handle 6, the seat handle 6 rotates the seat connecting shaft 3, causing the spray activation linkage 5 to depress the spray nozzle 23 of the air freshener bottle 22 provided in the air freshener compartment 20 (FIG. 3). Accordingly, air freshener is sprayed from the air freshener bottle 22 through the spray nozzle 23 and exits the air freshener compartment 20 through the air freshener openings 21. Upon lowering of the toilet cover 29 back onto the toilet seat 28 by lowering of the cover handle 11, the cover handle 11 rotates the cover connecting rod 10, causing the liquid sanitizer (not shown) to be dispensed from the sanitizer bottle 17, through the sanitizer fluid conduit 13 and from the dispensing nozzle 11*a*, respectively, onto the hands (not shown) of the user. Therefore, the user (not shown) need not touch the toilet cover 29 or toilet seat 28 with his or her hands during use of the toilet 26.

While the preferred embodiments of the invention have been described above, it will be recognized and understood that various modifications can be made in the invention and the appended claims are intended to cover all such modifications which may fall within the spirit and scope of the invention.

What is claimed is:

1. A toilet seat lift system for a toilet having a toilet bowl, comprising:

a seat connecting shaft adapted for attachment to the toilet bowl;

a toilet seat carried by said seat connecting shaft;

a cover connecting rod extending through said seat connecting shaft;

a toilet cover carried by said cover connecting rod;

a seat handle carried by said seat connecting shaft;

a cover handle carried by said cover connecting rod;

a dispensing nozzle provided in said cover handle;

a sanitizer bottle communicating with said dispensing nozzle; and a sanitizer fluid conduit extending through said cover handle and connecting said sanitizer bottle to said dispensing nozzle.

2. The toilet seat lift system of claim 1 further comprising a mounting plate adapted for attachment to said toilet bowl and wherein said seat connecting shaft is carried by said mounting plate.

3. The toilet seat lift system of claim 2 further comprising at least one shaft mount bracket carried by said mounting plate and wherein said seat connecting shaft extends through said at least one shaft mount bracket.

4. The toilet seat lift system of claim 3 further comprising a shaft flange extending from said seat connecting shaft and wherein said toilet seat is carried by said shaft flange.

5. The toilet seat lift system of claim 3 further comprising a rod flange extending from said cover connecting rod and wherein said toilet cover is carried by said rod flange.

6. The toilet seat lift system of claim 2 further comprising a sanitizer compartment carried by said mounting plate and wherein said sanitizer bottle is provided in said sanitizer compartment.

7. A toilet seat lift system for a toilet having a toilet bowl, comprising:

a seat connecting shaft adapted for attachment to the toilet bowl;

a toilet seat carried by said seat connecting shaft;

a cover connecting rod extending through said seat connecting shaft;

a toilet cover carried by said cover connecting rod;

a seat handle carried by said seat connecting shaft;

a cover handle carried by said cover connecting rod;

a spray activation linkage carried by said seat connecting shaft;

an air freshener bottle having a spray nozzle attached to said spray activation linkage;

a dispensing nozzle provided in said cover handle;

a sanitizer bottle communicating with said dispensing a sanitizer fluid conduit extending through said cover handle and connecting said sanitizer bottle to said dispensing nozzle.

8. The toilet seat lift system of claim 7 further comprising a mounting plate adapted for attachment to said toilet bowl and wherein said seat connecting shaft is carried by said mounting plate.

9. The toilet seat lift system of claim 8 further comprising a sanitizer compartment carried by said mounting plate and wherein said sanitizer bottle is provided in said sanitizer compartment.

10. The toilet seat lift system of claim 8 further comprising an air freshener compartment having a plurality of air freshener openings carried by said mounting plate and wherein said air freshener bottle is provided in said air freshener compartment.

* * * * *